US005323747A

United States Patent [19]

Büchl Josef

[11] Patent Number: 5,323,747

[45] Date of Patent: Jun. 28, 1994

[54] ELECTRICALLY INFLUENCED THROTTLE VALVE CONTROL DEVICE

[75] Inventor: Büchl Josef, Lenting, Fed. Rep. of Germany

[73] Assignee: Audi AG, Ingolstadt, Fed. Rep. of Germany

[21] Appl. No.: 946,309

[22] PCT Filed: Apr. 19, 1991

[86] PCT No.: PCT/EP91/00753

§ 371 Date: Nov. 2, 1992

§ 102(e) Date: Nov. 2, 1992

[87] PCT Pub. No.: WO91/18194

PCT Pub. Date: Nov. 28, 1991

[30] Foreign Application Priority Data

May 18, 1990 [DE] Fed. Rep. of Germany ..... 4016008

[51] Int. Cl.[5] ..... F02D 11/10

[52] U.S. Cl. ..... 123/399

[58] Field of Search ..... 123/342, 361, 396, 399

[56] References Cited

U.S. PATENT DOCUMENTS 4,719,891 1/1988 Porth et al. ..... 123/472 X
4,951,772 8/1990 Peter et al. ..... 123/361 X
4,966,114 10/1990 Basten ..... 123/396
5,002,032 3/1991 Kolberg ..... 123/399
5,107,811 4/1992 Huber et al. ..... 123/399
5,141,070 8/1992 Hickmann et al. ..... 123/396 X
5,172,667 12/1992 Spiegel ..... 123/399

FOREIGN PATENT DOCUMENTS 3730239 3/1989 Fed. Rep. of Germany .

*Primary Examiner*—Tony M. Argenbright
*Attorney, Agent, or Firm*—Lalos & Keegan

[57] ABSTRACT

An electrically influenced throttle valve control for an internal combustion engine comprising a transmission link moved by operating an accelerator pedal against the load exerted by at least one return spring and transmitting the magnitude of the movement by way of a sensor, an intermediate member connected by a first spring to the transmission link and biased in its open limit position by the spring in normal operation, a throttle actuator connected by a second spring to the intermediate member, an electric motor for operating the throttle actuator, and an actual value transmitter associated with the throttle actuator.

6 Claims, 1 Drawing Sheet

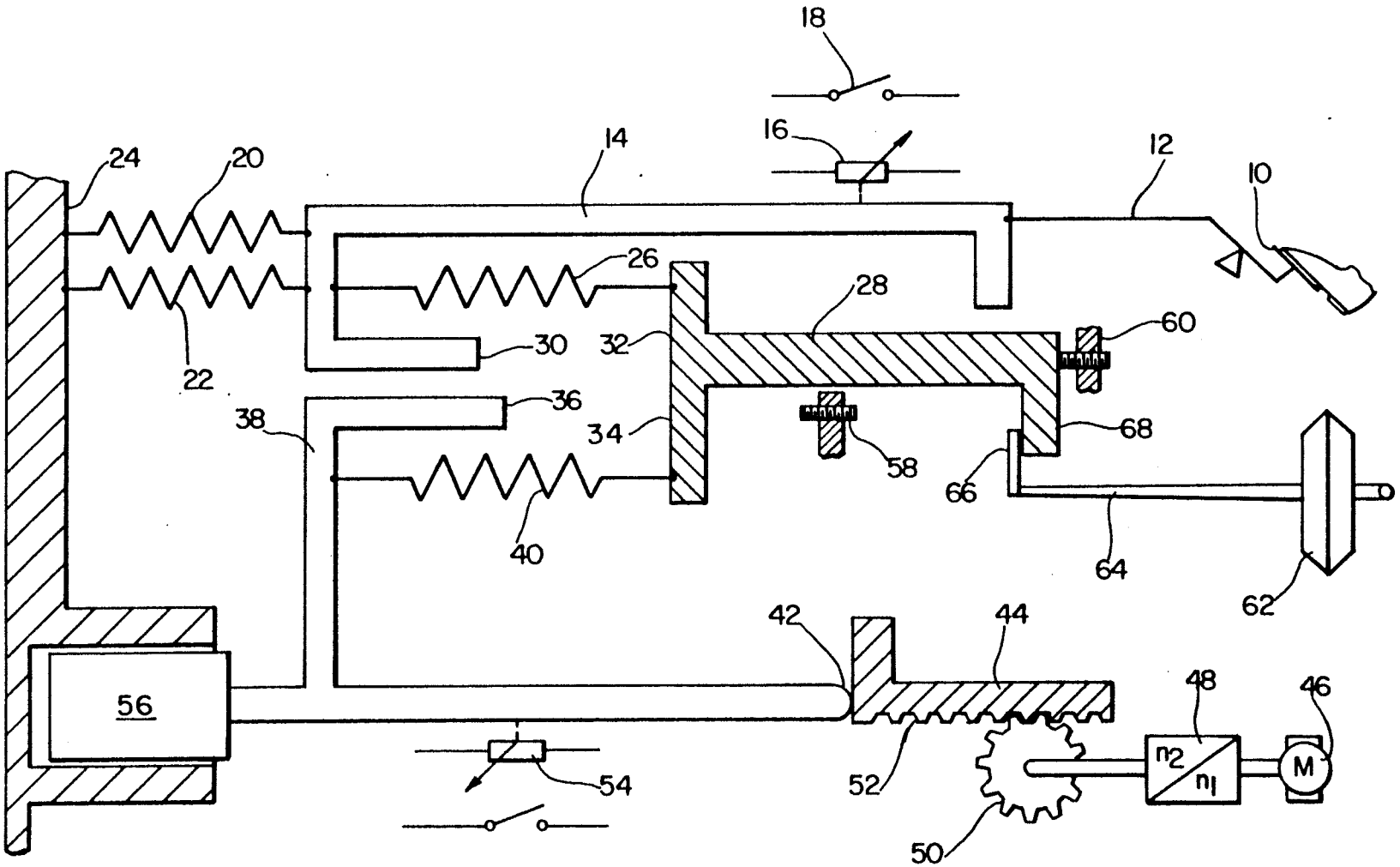
10
12
14
16
18
20
22
24
26
28
30
32
34
36
38
40
42
44
46
48
50
52
54
56
58
60
62
64
66
68
M
n1
n2

ELECTRICALLY INFLUENCED THROTTLE VALVE CONTROL DEVICE

The invention relates to an electrically influenced throttle valve control means.

An example of such a device is shown from the European patent application 89105278.7 , published on Mar. 10, 1990 as Document Number 0 389 649. Also the European patent application 88114519.7, published on Nov. 15, 1989 as Document number 0 341 341, describes a throttle valve control means in which the mechanical depressing of the accelerator pedal defines the maximum open position of the throttle valve, whereas the throttle valve can be shifted in a more closed position by an electric motor. If there is detected a misfunction of the electric motor, a coupling between the electric motor and the throttle valve must be opened in order to have a mechanical movement of the throttle valve.

It is object of the invention to simplify the construction described therein.

According to the invention, movement of the accelerator pedal is transmitted during normal operation to a transmission link which operates a throttle butterfly actuator by means of a suitable actual value transmitter.

The intermediate member to be provided is moved to a position in which it makes no contact with the transmission link and the throttle butterfly actuator and is merely linked with these two components by a spring.

In an emergency operating condition, accelerator pedal movement is transmitted mechanically by way of the intermediate piece, whereby construciton in accordance with the invention retains a high level of operating convenience.

The invention is described in detail below, with reference to the FIGURE.

Reference number 10 relates to a conventional accelerator pedal in the footwell of a motor vehicle, movement of which is transmitted by wire cable 12 to a transmission link 14 which can for instance be the wire cable pulley. Said transmission link is moved in proportion to the amount by which accelerator pedal 10 is depressed, as shown by schematic displacement to the right in the FIGURE. An actual value transmitter 16 associated with transmission link 14 registers the magnitude of the displacement movement and supplies an output signal of a corresponding value. This actual value transmitter can for example be a potentiometer. In addition, an idle switch 18 is associated with transmission link 14, and makes contact when accelerator pedal 10 is not depressed at all.

A return spring cluster consisting of springs 20 and 22 applies a force to transmission link 14 in a direction opposed to its direction of movement when accelerator pedal 10 is depressed. This return spring cluster is pivoted to a mount 24 at the engine end. This ensures that transmission link 14 is moved to its idle position if accelerator pedal 10 is not operated.

An initial spring 26 connects transmission link 14 with an intermediate piece 28 in such a way that a load is exerted on intermediate piece 28 in the direction of transmission link 14, that is to say in the closing direction.

Furthermore, intermediate piece 28 is connected by a spring 40 to a throttle butterfly actuator 38. Spring 40 applies a load to intermediate piece 28 and throttle butterfly actuator 38 so that they tend to move towards each other.

Throttle butterfly actuator 38 is connected to throttle butterfly 56, which is closed by a movement to the left as shown in the FIGURE and opened by a movement to the right as shown in the FIGURE.

The position of throttle butterfly actuator 38 is influenced by a second actuator 44, which can apply pressure at point 42 to force the throttle butterfly into the closed position. The position of second actuator 44 is controlled by an electric motor 46, which in the schematic representation drives a gear wheel 50 by way of reduction gears 48. Said gear wheel 50 acts together with a toothed rack 52 to move the second actuator in the FIGURE to the right or left as appropriate. In order to ensure operation in an emergency, the control means for the second actuator 44 must not be self-locking in its action.

It can be regarded as evident that in a practical version the schematic movements to left and right would take the form of rotary movements and that the electric motor could also move the second actuator 44 by other suitable means, The important aspect is the function, namely that actuator 44 moves throttle butterfly actuator 38 in the direction which closes throttle butterfly 56, in conjunction with which movement the position of throttle butterfly actuator 38 is registered by an actual value transmitter 54 and an associated idle switch.

If the second actuator 44 is activated by electric motor 46 and moves throttle butterfly actuator 38 to its closing position, the second spring 40 is stretched by a corresponding amount This enables throttle butterfly 56 to be closed further by means of electric motor 46.

A pneumatic actuating means applies a force by way of rod 64 and projection 66 to a corresponding projection 68 on intermediate piece 28 in the throttle butterfly opening direction. When intermediate piece 28 is in its fully open position it strikes a full load stop 60; the minimum movement position of intermediate piece 28, on the other hand, is formed by an emergency idle stop 58.

This pneumatic actuating means is activated during normal operation, so that intermediate piece 28 is moved to the fully open position In this way the position of throttle butterfly 56 is obtained solely by way of electric motor 46, which is influenced by desired value transmitter 16 and actual value transmitter 54.

When released by pneumatic actuating means 62, intermediate piece 28 is exposed to the force exerted by spring 26 and, as shown schematically by the endfaces 34 and 36, comes to rest against throttle butterfly actuator 38. When throttle butterfly 56 is closed, projection 68 touches emergency idle adjusting means 58 as a consequence of the geometrical dimensions of intermediate piece 28 and throttle butterfly actuator 38.

Contact faces 30 and 32 between transmission link 14 and intermediate piece 28 are not in contact with one another when accelerator pedal 10 is not depressed, since transmission link 14 is held in the minimum deflection position by the superior strength of return spring cluster 20 and 22 and spring 26 is accordingly slightly stretched. A stop intended for transmission link 14 in its closed position is matched to stop 58 for intermediate piece 28 in such a way as to ensure that endfaces 30 and 32 remain separated.

In an emergency operating situation, for example if electric motor 46 should fail, pneumatic actuating means 62 is vented and releases intermediate piece 28 accordingly. If accelerator pedal 10 is not operated, the position just described is reached. If accelerator pedal 10 is depressed, transmission link 14 is displaced and face 30 on transmission link 14 makes contact with face 32 on intermediate piece 28, so that the latter is displaced. The force exerted by spring 40 keeps endface 36 of throttle butterfly actuator 38 in contact with face 34 of intermediate piece 28, so that the movement initiated when accelerator pedal 10 is depressed is transmitted to throttle butterfly actuator 38. This causes throttle butterfly 56 to open. At the same time electric motor 46 with gears 48 is forced into its "Open" position.

In particular if malfunction of electric motor 46 causes second actuator 44 to open completely, the throttle butterfly is only opened by being released by intermediate piece 28 as far as is desired by depressing accelerator pedal 10.

The arrangement constituting the invention has a number of advantages, some of which are listed below.

Regulating movements of actuating motor 46 and the associated opening or closing of throttle butterfly 56 do not have the effect of exerting any force on accelerator pedal 10. All such effects are absorbed by spring 40.

The relative spring ratings are not critical.

Finite force requirements are imposed on actuating motor 46 for operation of throttle butterfly 56, since the motor has only to overcome the force exerted by spring 40. All other springs (26, 20, 22) are not influenced or stretched by the electric motor.

The simple layout and construction shown here, with intermediate piece 28 and pneumatic actuating means 62 avoids the need for an expensive and complex magnetic clutch, which would also occupy a considerable amount of space.

A critical situation does not arise if actuating motor 46 or gears 48 should jam; the throttle butterfly can always be closed in this situation.

If a speed regulating system (cruise control) is operated, additional safety is assured by incorporating the pneumatic adjusting means into the logic of said system.

If a speed regulating system (cruise control) is operated, desired value potentiometer 16 is pulled to the idle position by main return spring system 20 and 22. Compared with other systems, this ensures greater safety. In such other systems a smaller additional spring is provided for this purpose and must be matched in rating to the other springs.

To monitor correct functioning, electric motor 46 is run briefly to its opening position when the ignition is switched on but before the engine is started. If in this condition pneumatic actuating means 62 were to malfunction and not release intermediate piece 28, throttle butterfly actuator would open and this would be registered by the actual value potentiometer, enabling a suitable fault signal to be supplied This monitoring procedure lasts approximately 30–40 msec and the driver is therefore not aware of it having taken place when the vehicle is started.

The difference in the gaps between endfaces 30 and 36 respectively and intermediate piece 28 ensures that transition from normal operation (with electrical influencing) to mechanical emergency operation does not cause throttle butterfly 56 to open suddenly.

I claim:

1. An electrically influenced throttle valve control means for an internal combustion engine comprising:

a transmitting means moved by operating an accelerator pedal against the load exerted by at least one return spring and transmitting the magnitude of the movement by way of a sensor, an intermediate member connected by a first spring to the transmitting means and biased in its open limit position by the spring in normal operation, a throttle actuator means connected by a second spring to the intermediate member, an actuating means for operating the throttle actuator means, and an actual value transmitter associated with the throttle actuator means.

2. An electrically influenced throttle valve control means according to claim 1, wherein the intermediate member is released in the emergency operating condition and is brought into engagement by the second spring with the throttle actuator means so that the movement of the intermediate piece is transmitted mechanically to the throttle actuator means.

3. An electrically influenced throttle valve control means according to claim 2, wherein the transmitting means actuates the intermediate member in the emergency operating condition.

4. An electrically influenced throttle valve control means according to claim 3, whereupon in the emergency operating condition, the intermediate member is in engagement with the throttle actuator means and the transmitting means is out of engagement with the intermediate member until the accelerator pedal is depressed.

5. An electrically influenced throttle valve control means according to claim 1, 2, 3 or 4, further comprising a pneumatic actuating means which holds the intermediate member in its open position during normal operation.

6. An electrically influenced throttle valve control means according to claim 1, 2, 3 or 4, wherein the actuating means closes the throttle valve when the throttle actuating means is activated, and the throttle valve is opened by the force exerted by the second spring between the throttle actuating means and the intermediate member.

* * * * *